US006206097B1

(12) United States Patent
Stephens

(10) Patent No.: US 6,206,097 B1
(45) Date of Patent: Mar. 27, 2001

(54) VERTICAL PUMPING SYSTEM

(75) Inventor: Richard A. Stephens, Bartlesville, OK (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/304,746

(22) Filed: May 4, 1999

(51) Int. Cl.[7] ..... E21B 43/01; E21B 43/12

(52) U.S. Cl. ..... 166/112; 166/105; 166/106; 417/423.3; 417/424.1

(58) Field of Search ..... 166/105, 106, 166/112; 417/423.3, 424.1; 137/236.1, 564.5, 565, 571

(56) References Cited

U.S. PATENT DOCUMENTS

| | | | | |
|---|---|---|---|---|
| 3,891,031 | * | 6/1975 | Ortiz | 166/106 X |
| 3,939,909 | * | 2/1976 | Ortiz | 166/106 X |
| 4,065,232 | * | 12/1977 | Stratienko | 417/368 |
| 4,289,456 | | 9/1981 | Ishihara | 417/364 |
| 4,576,197 | * | 3/1986 | Kempers | 137/565 |
| 4,930,576 | * | 6/1990 | Berryman et al. | 166/308 |
| 5,006,053 | * | 4/1991 | Seno | 418/150 |
| 5,951,248 | | 9/1999 | Hall | 415/213 |

FOREIGN PATENT DOCUMENTS

| | | |
|---|---|---|
| 588393 | 1/1945 | (GB) . |
| 1132698 | 11/1968 | (GB) . |
| 1139820 | 1/1969 | (GB) . |
| 1238208 | 7/1971 | (GB) . |
| 1309510 | 3/1973 | (GB) . |
| 1406827 | 9/1975 | (GB) . |

OTHER PUBLICATIONS

John L. Dicmas, Vertical Turbine, Mixed Flow, and Propeller Pumps, pp. 11, 24–25.

* cited by examiner

*Primary Examiner*—Eileen D. Lillis
*Assistant Examiner*—Tara L. Mayo
(74) *Attorney, Agent, or Firm*—Fletcher, Yoder & Van Someren

(57) ABSTRACT

A pumping assembly for use on an offshore drilling platform. The pumping assembly includes a vertical pump designed for mounting on the deck of an offshore drilling platform. The pump is a vertical pump that includes a fluid intake, a fluid discharge, a rotatable shaft, and a fluid driving mechanism to draw fluid into the fluid intake and to discharge fluid through the fluid discharge. A seal is mounted about the rotatable shaft to prevent leaking of the pumped fluid along the rotatable shaft. Additionally, a power source is coupled to the rotatable shaft to power the vertical pump. The fluid discharge is oriented to discharge fluid in a direction generally axially aligned with the rotatable axis to limit transverse forces on the seal.

20 Claims, 3 Drawing Sheets

VERTICAL PUMPING SYSTEM

FIELD OF THE INVENTION

This invention relates generally to a fluid pumping system. More particularly, the present invention relates to an improved vertical pumping system for use in pumping fluids on offshore drilling platforms.

BACKGROUND OF THE INVENTION

A variety of pumping systems are used on offshore drilling platforms to pump fluid such as oil and sea water. A conventional pumping system includes a horizontal motor coupled to a horizontal pump. The horizontal motor and pump are mounted to the deck of the drilling platform and used to pump fluids through appropriate conduits coupled to the pump. Such horizontal systems, however, require a relatively large area or "footprint" on the drilling platform. The large footprint is problematic because of the relatively severe space constraints on offshore drilling platforms.

An alternative to a horizontal system is a vertical pumping system mounted vertically on the offshore drilling platform. Vertical pumping systems employ a motor and a vertical pump connected by a motive power coupling. The internal components of a vertical pump, such as the impeller(s) and a rotatable drive shaft, are oriented vertically. Because of this vertical orientation, a vertical pumping system requires a smaller area (or "footprint") than a comparable horizontal pumping system. Because offshore drilling platforms have very limited deck space, the smaller footprint available with vertical pumping systems makes them better suited for use in offshore drilling platforms.

Vertical pumping systems employed to transfer fluids or to pump liquids from wells or deep drilled bore holes are comprised of a motor and a vertical centrifugal pump. Vertical turbine pumps are commonly used for this application. The motor drives a rotatable shaft in the vertical pump that is, in turn, connected to the impellers of the vertical turbine pump. The pump is mounted to the deck of the drilling platform, while the motor remains above the deck. As the motor rotates, the rotatable shaft rotates the impellers. As the impellers rotate they impart motion to the fluid.

The pump suction is located at the bottom of the pump and the fluid is drawn upward through the pump and the deck, and is discharged above the deck surface at or near the top of the pump. A mechanical seal is located around the rotatable drive shaft near the motor to act as a barrier to prevent fluid from leaking out of the pump around the shaft. The mechanical seal is thus exposed to fluid at pump discharge pressure on one side and, typically, atmospheric pressure on the other. The pump discharge pressure may be several thousand pounds per square inch greater than atmospheric or pump suction pressure. The mechanical shaft seal must be designed and manufactured to withstand the considerable strain placed on it by fluid at pump discharge pressure.

The present invention overcomes the problems of the prior art and provides an apparatus which employs a vertical pump in a manner which reduces the strain on the mechanical seal by exposing the mechanical seal to the lower pressure at the pump suction rather than the much higher pressure at the pump discharge.

SUMMARY OF THE INVENTION

The present invention features an offshore pumping assembly for use on an offshore rig to pump a fluid. The system includes a deck of the offshore rig to which a vertical pump is mounted. The vertical pump includes a fluid intake, a fluid discharge, a rotatable shaft, a turbine connected to the shaft and a seal mounted about the rotatable shaft. The system further includes a power source coupled to the rotatable shaft. As the shaft and the turbine are rotated by the power source, a fluid is pumped from the fluid intake through the fluid discharge without loading of the seal with a fluid discharge pressure.

According to another aspect of the invention, a fluid pumping system is configured for mounting to a deck of an offshore platform used in pumping a production fluid. The system comprises a vertical pump and an external motive power source. The vertical pump includes a drive shaft, an impeller, and a shaft seal disposed about the drive shaft and located upstream of the impeller. The power source is coupled to the drive shaft to power the vertical pump. The orientation of the impeller, drive shaft and shaft seal are such that the shaft seal is exposed to vertical pump suction pressure, as opposed to discharge pressure, when the fluid pumping system is in operation.

According to a further aspect of the invention, a fluid pumping system is provided for use on a drilling platform. The pumping system includes a vertical pump configured for mounting to a drilling platform. The vertical pump includes a drive shaft and a shaft seal disposed about the drive shaft to prevent leakage of a pump fluid along the drive shaft. When the vertical pump is mounted to the drilling platform and operated, the shaft seal is exposed to suction pressure of the vertical pump, which allows the use of a low pressure seal.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
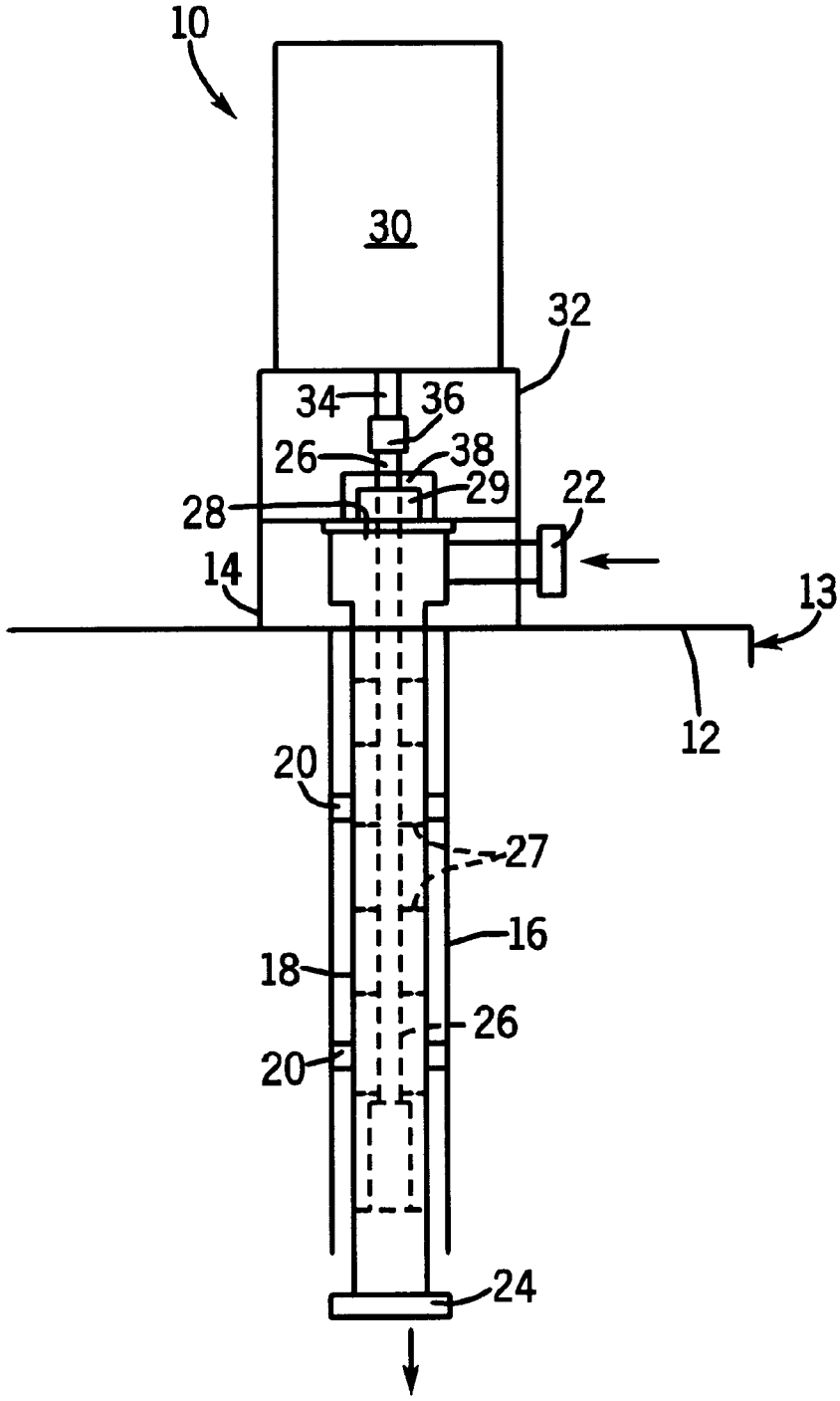
FIG. 1 is a front, sectional view, partially cutaway, of a vertical pumping system that may be employed in accordance with this invention.

Referring generally to FIG. 1, a vertical pumping system 10 is illustrated that can be mounted on a deck 12 of an offshore drilling platform 13. A circular steel base 14 is mounted to the deck 12 and provides support for other components of the vertical pumping system 10. A steel pipe 16 is mounted to the underside of the circular steel base 14 and descends downward below the deck level to provide alignment and lateral support to a vertical pump 18. The vertical pump 18 is mounted to the circular steel base 14 and extends downward inside the steel pipe 16. Pump supports 20 inside the steel pipe 16 provide alignment and lateral support for the vertical pump 18.

A fluid is drawn into vertical pumping system 10 through a pump intake assembly 22 mounted to vertical pump 18 and protruding laterally out of the circular steel base 14. The fluid is moved through vertical pump 18 and discharged through a discharge outlet 24, preferably oriented generally vertically downward, as illustrated in FIG. 1.

Vertical pump 18 further includes a rotatable shaft 26 to which a plurality of impellers or a turbine 27 is mounted. Shaft 26 extends outwardly from vertical pump 18 at a top end 28 disposed generally opposite discharge outlet 24. A seal 29 is disposed about shaft 26 and between shaft 26 and the housing that forms top end 28 of pump 18. Seal 29 prevents leakage of the pumped fluid along shaft 26 during operation of the vertical pumping system 10.

Exemplary vertical pumps 18 include standard turbine pumps, such as those available from Reda (a division of Camco International, Inc.) of Bartlesville, Okla. Furthermore, exemplary seals 29 include relatively low expense, low pressure seals, such as those built to the API 682 Standard, and commercially available from the John Crane or Flow Serve companies. The orientation of the pump and the flow direction of the pumped fluid permit the use of a less expensive, low pressure seal, because the seal is not subjected to the high discharge pressures generated by vertical pump 18.

Motive power is transmitted to the vertical pump via a power source 30, such as an electric motor or internal combustion engine, both commonly used for powering petroleum transfer pumps. Preferably, power source 30 comprises a vertically oriented electric motor supported by a motor support 32 mounted to the circular steel base 14. The vertical motor includes a vertically oriented drive shaft 34. Drive shaft 34 is coupled to the rotatable shaft 26 of pump 18 via a coupling 36. Additionally, rotatable shaft 26 is held in place with respect to coupling 36 by a thrust chamber 38 having a thrust bearing.

Thrust chamber 38 absorbs the high axial loads generated along rotatable shaft 26 due to the generally axial discharge of pumped fluid through discharge outlet 24. Thus, seal 29 absorbs little, if any, of the force generated along rotatable shaft 26 and impellers 27 due to the high pressure discharge of fluid. In fact, any forces acting on seal 29 are primarily generated due to the suction of fluid through fluid inlet 22.

The forces generated due to the suction at inlet 22 and the surrounding atmospheric pressure tend to be much less than the discharge pressures. For example, in some systems, the pressures exerted proximate inlet 22 may be on the order of 100 psi, whereas the pressures generated at discharge outlet 24 may on the order of 5,000 psi. Thus, by orienting pump 18 and impellers/turbine 27 to draw fluid into generally horizontal inlet 22 and discharge the fluid downwardly through generally vertical discharge outlet 24, a much less expensive, low pressure seal 29 may be used between rotatable shaft 26 and the housing forming pump top end 28. Additionally, this orientation of vertical pump 18 reduces the repair and service time otherwise required for a conventional pump 18 in which the components are oriented to discharge fluid transversely to the axis about which shaft 26 rotates. Furthermore, the utilization of a vertical pump 18 in combination with a vertical electric motor provides a small footprint that is advantageous for use on drilling platforms.

Figure 2:
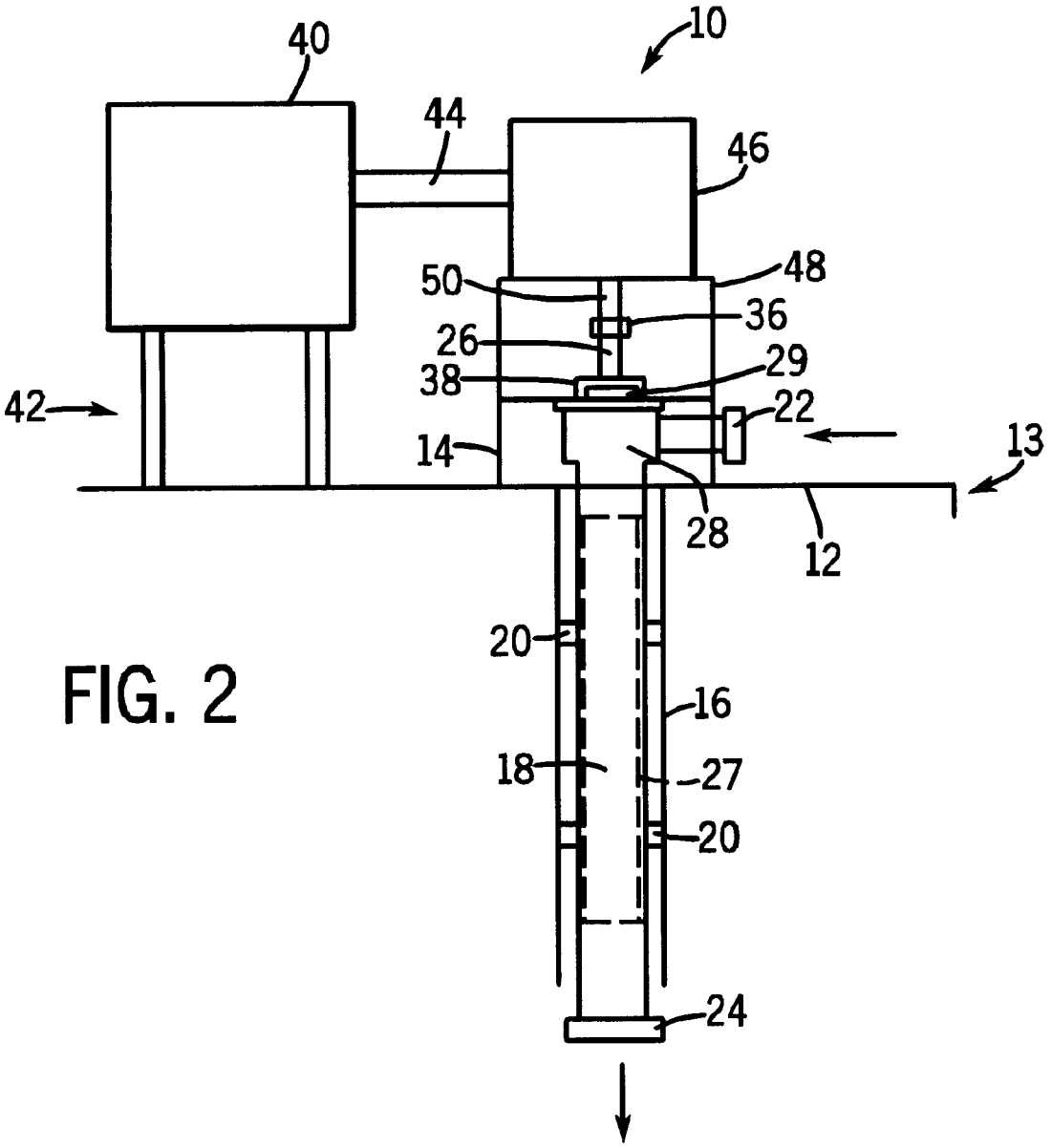
FIG. 2 is a front sectional view, partial cutaway, of an alternative embodiment of a vertical pumping system that may be employed in accordance with this invention.

Referring generally to FIG. 2, an alternate embodiment of the present invention is illustrated. In this embodiment, the same reference numerals have been utilized as in FIG. 1 where the components are similar, and new or changed components are labeled with unique reference numerals.

The embodiment illustrated in FIG. 2 may be utilized on drilling platforms 13 where space constraints are less problematic. In this embodiment, a motive power source 40 is mounted to deck 12 by a support structure 42. Power source 40 is horizontally oriented in that it includes a generally horizontal drive shaft 44. For example, power source 40 may be a horizontal electric motor or an internal combustion engine.

Drive shaft 44 preferably is coupled to a gear box 46 which, in turn, is mounted on a gear box support 48. Support 48 is mounted to or part of base 14.

In the illustrated embodiment, gear box 46 is a right-angle gear box having an output shaft 50 disposed generally at a right-angle with drive shaft 44 when gear box 46 is mounted between power source 40 and pump 18. Output shaft 50 is oriented downwardly for connection to rotatable shaft 26 via coupling 36. Output shaft 50 rotates rotatable shaft 26 to drive vertical pump 18. The orientation of vertical pump 18 and its various components is the same as that described above with reference to FIG. 1. In other words, the pump fluid is drawn into the pumping system through generally horizontal inlet 22 and discharged axially, preferably in a downward direction, through discharge outlet 24.

Figure 3:
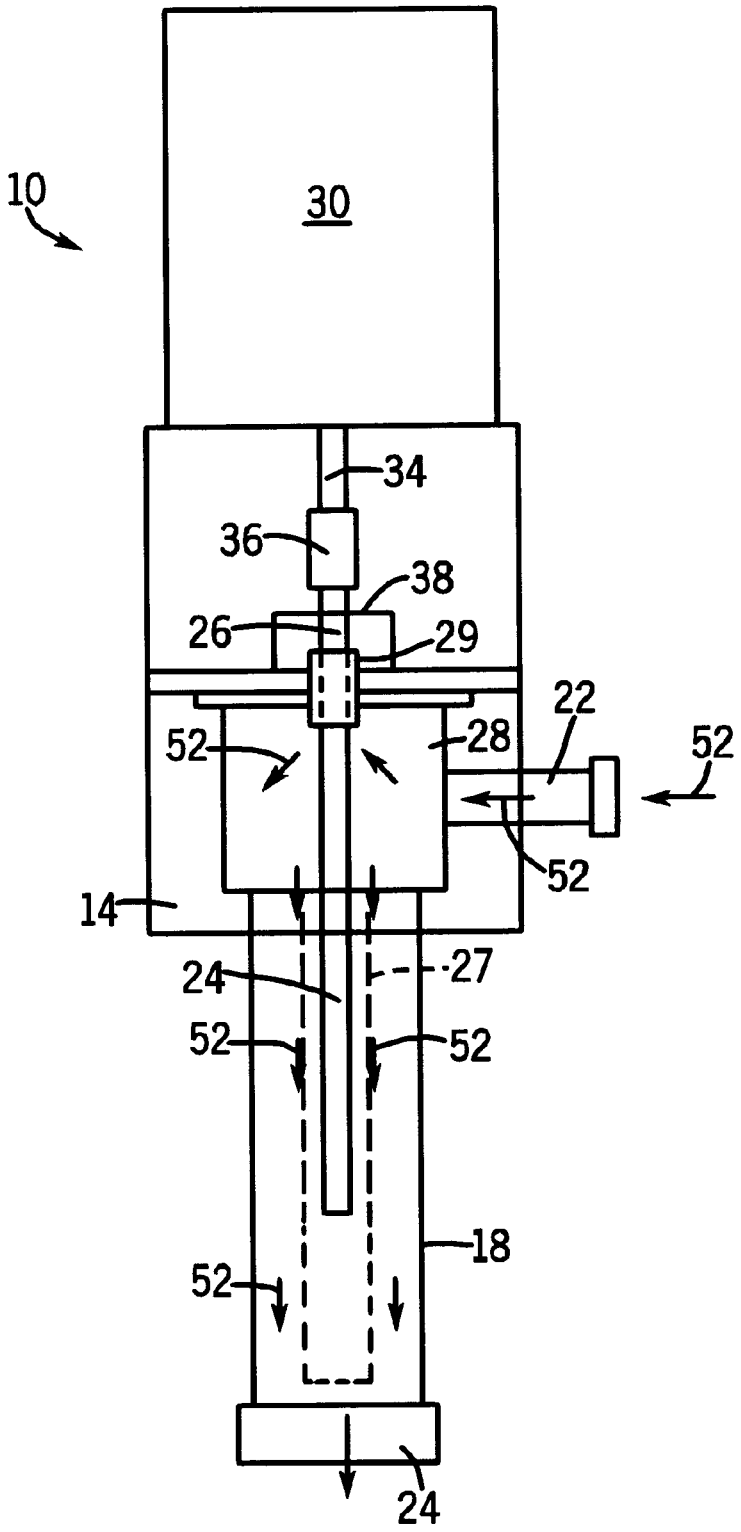
FIG. 3 is front sectional view, partially cutaway, of a vertical pump, showing fluid flow through the vertical pumping system.

Regardless of the orientation of power sources 30, 40 with respect to pump 18, the beneficial effects with respect to seal 29 are the same. In either embodiment, a pump or produced fluid, represented by arrows 52 of FIG. 3, is pumped from a desired supply to a desired destination without allowing the high discharge pressures to act against seal 29.

The angle of inlet 22 relative to discharge outlet 24 may vary depending on design considerations and space constraints, but preferably inlet 22 is oriented approximately perpendicularly to discharge outlet 24. As described above, this allows fluid 52 to be discharged in a generally axial direction with respect to rotatable axis 26. In the typical drilling platform environment, the pumped fluid 52 is drawn into pump 18 in a generally horizontal direction and discharged in a generally downward vertical direction, as reflected by the arrows representing pumped fluid 52. Effectively, a conventional thrust bearing or thrust chamber 38, rather than seal 29, can be utilized to absorb the forces generated under the high pressure discharge of pumped fluid 52.

It will be understood that the foregoing description is of preferred embodiments of this invention, and that the invention is not limited to the specific forms shown. For example, a variety of vertical pumps of various sizes may be utilized; various power sources may be used; the mounting structures and support structures may be changed or adjusted according to the environment or drilling platform design; and the discharged fluid may be discharged either upwardly or downwardly depending on the desired application. These and other modifications may be made in the design and arrangement of the elements without departing from the scope of the invention as expressed in the appended claims.

What is claimed is:

1. An offshore pumping system for pumping a fluid, comprising:

a deck of an offshore rig;

a vertical pump mounted to the deck, the vertical pump including a fluid intake, a fluid discharge, a rotatable shaft, a fluid driving mechanism connected to the rotatable shaft and a mechanical seal mounted about the rotatable shaft; and a power source coupled to the rotatable shaft, wherein as the rotatable shaft and the fluid driving mechanism are rotated by the power source, a fluid is pumped from the fluid intake through the fluid discharge without loading the mechanical seal to a fluid discharge pressure.

2. The offshore pumping assembly as recited in claim 1, wherein the power source comprises an electric motor mounted vertically above the vertical pump.

3. The offshore pumping assembly as recited in claim 2, wherein the electric motor includes a generally vertical motor shaft coupled to the rotatable shaft.

4. The offshore pumping assembly as recited in claim 1, wherein the power source comprises a horizontal motor coupled to the vertical pump by a gear box.

5. The offshore pumping assembly as recited in claim 4, wherein the gear box is a right angle gear box.

6. The offshore pumping assembly as recited in claim 1, wherein the power source comprises an internal combustion engine having an engine shaft coupled to the rotatable shaft of the vertical pump by a gear box.

7. The offshore pumping assembly as recited in claim 6, wherein the gear box is a right angle gear box.

8. A fluid pumping system configured for mounting to a deck of an offshore platform used in pumping a production fluid, comprising:

a vertical pump comprising a drive shaft, an impeller, and a shaft seal disposed about the drive shaft and located upstream of the impeller, and an external motive power source coupled to the drive shaft, wherein the shaft seal is exposed to vertical pump suction pressure when the fluid pumping system is in operation.

9. The fluid pumping system as recited in claim 8, wherein the shaft seal is a mechanical seal.

10. The fluid pumping system as recited in claim 8, wherein the vertical pump is a turbine pump.

11. The fluid pumping system as recited in claim 8, wherein the vertical pump is adapted to be mounted to a deck of a platform.

12. The fluid pumping system as recited in claim 8, wherein the motive power source comprises an electric motor mounted vertically above the vertical pumping system.

13. The fluid pumping system as recited in claim 12, wherein the electric motor includes a generally vertical drive shaft.

14. The fluid pumping system as recited in claim 8, wherein the power source comprises an internal combustion engine mounted adjacent to the vertical pumping system.

15. The fluid pumping system as recited in claim 14, wherein the internal combustion engine includes a generally horizontal drive shaft coupled to the vertical pump by a right-angle gear box.

16. A fluid pumping system for use on a drilling platform, comprising:

a vertical pump configured for mounting to a drilling platform and including a drive shaft and a shaft seal disposed about the drive shaft to prevent leakage of a pumped fluid along the drive shaft, wherein when the vertical pump is mounted to the drilling platform and operated, the shaft seal is exposed to suction pressure of the vertical pump.

17. The fluid pumping system as recited in claim 16, further comprising a motive power source coupled to the drive shaft.

18. The fluid pumping system as recited in claim 16, wherein the shaft seal is a lower pressure seal.

19. The fluid pumping system as recited in claim 16, wherein the vertical pump is a turbine pump.

20. The fluid pumping system as recited in claim 16, wherein the motive power source comprises an electric motor mounted vertically above the vertical pumping system.

* * * * *